US006642486B1

(12) United States Patent
Anderson et al.

(10) Patent No.: US 6,642,486 B1
(45) Date of Patent: Nov. 4, 2003

(54) METHOD AND APPARATUS FOR REPLICATING HEAT PROFILE OF INFRARED OVEN

(75) Inventors: Scott J. Anderson, Vadnais Heights, MN (US); James S. Nelson, Mounds View, MN (US); Frank S. Villella, Spring Lake Park, MN (US); Matthew H. Yackel, Brooklyn Park, MN (US); Richard A. Ganyo, Eagan, MN (US); Thomas M. Sorensen, White Bear Lake, MN (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/289,649

(22) Filed: Nov. 7, 2002

(51) Int. Cl.[7] ..... F27B 17/00; F27B 5/18; F27D 19/00

(52) U.S. Cl. ..... 219/411; 219/386; 219/391; 219/412; 219/482; 219/483; 219/488; 373/135

(58) Field of Search ..... 219/411, 385, 219/386, 391, 412, 413, 482, 483, 488, 490; 373/135, 136

(56) References Cited

U.S. PATENT DOCUMENTS 5,003,160 A * 3/1991 Matsuo et al. ..... 219/483
6,207,936 B1 * 3/2001 de Waard et al. ..... 219/412
6,462,311 B1 * 10/2002 Emiglio ..... 219/391

OTHER PUBLICATIONS

CN 1334048 patent abstract, Feb. 6, 2002.*

* cited by examiner

*Primary Examiner*—Joseph Pelham
(74) *Attorney, Agent, or Firm*—Fletcher Yoder

(57) ABSTRACT

A system and method for developing a heat treatment process using a model radiative-heating oven, which repeatably and accurately simulates an industrial heat treatment system. In order to simulate the industrial heat treatment system, the model radiative-heating oven uses a variety of scaling factors, such as heating density parameters. The model radiative-heating oven also may have a quickly openable and closable object carrier, which facilitates a timely start and end of a desired heat treatment process. An oven temperature stabilizer also may be provided for thermally stabilizing the model radiative-heating oven prior to the desired heat treatment process. The present technique also may utilize a variety of heat profile controls, such as time, temperature, and power levels, to provide the desired heat profile in the heat treatment process.

52 Claims, 7 Drawing Sheets

METHOD AND APPARATUS FOR REPLICATING HEAT PROFILE OF INFRARED OVEN

BACKGROUND OF THE INVENTION

The present technique relates generally to heat treatment systems and, more particularly, to industrial finish curing systems. In specific, a system and method is provided for developing a heat treatment process for an industrial infrared oven using a model infrared oven and heat profile scaling factors.

Heat treatment processes are often used to alter the material characteristics of a structure or a surface material applied to the structure. For example, finish coatings, such as paint, are often applied to a product and subsequently cured via radiative-heating ovens. Industrial radiative-heating ovens are typically large, stationary, and intended for actual production lines, such as for curing paint applied to an automobile. In order to develop a heat treatment process, the actual industrial oven is typically used to test the effects of different heating times, levels, and so forth. Unfortunately, process development using the actual industrial oven is time-consuming, expensive, and it results in downtime from actual production.

Accordingly, a technique is needed for replicating the heat profile of the industrial radiative-heating oven in a model radiative-heating oven.

SUMMARY OF THE INVENTION

A system and method for developing a heat treatment process using a model radiative-heating oven, which repeatably and accurately simulates an industrial heat treatment system. In order to simulate the industrial heat treatment system, the model radiative-heating oven uses a variety of scaling factors, such as heating density parameters. The model radiative-heating oven also may have a quickly openable and closable object carrier, which facilitates a timely start and end of a desired heat treatment process. An oven temperature stabilizer also may be provided for thermally stabilizing the model radiative-heating oven prior to the desired heat treatment process. The present technique also may utilize a variety of heat profile controls, such as time, temperature, and power levels, to provide the desired heat profile in the heat treatment process.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
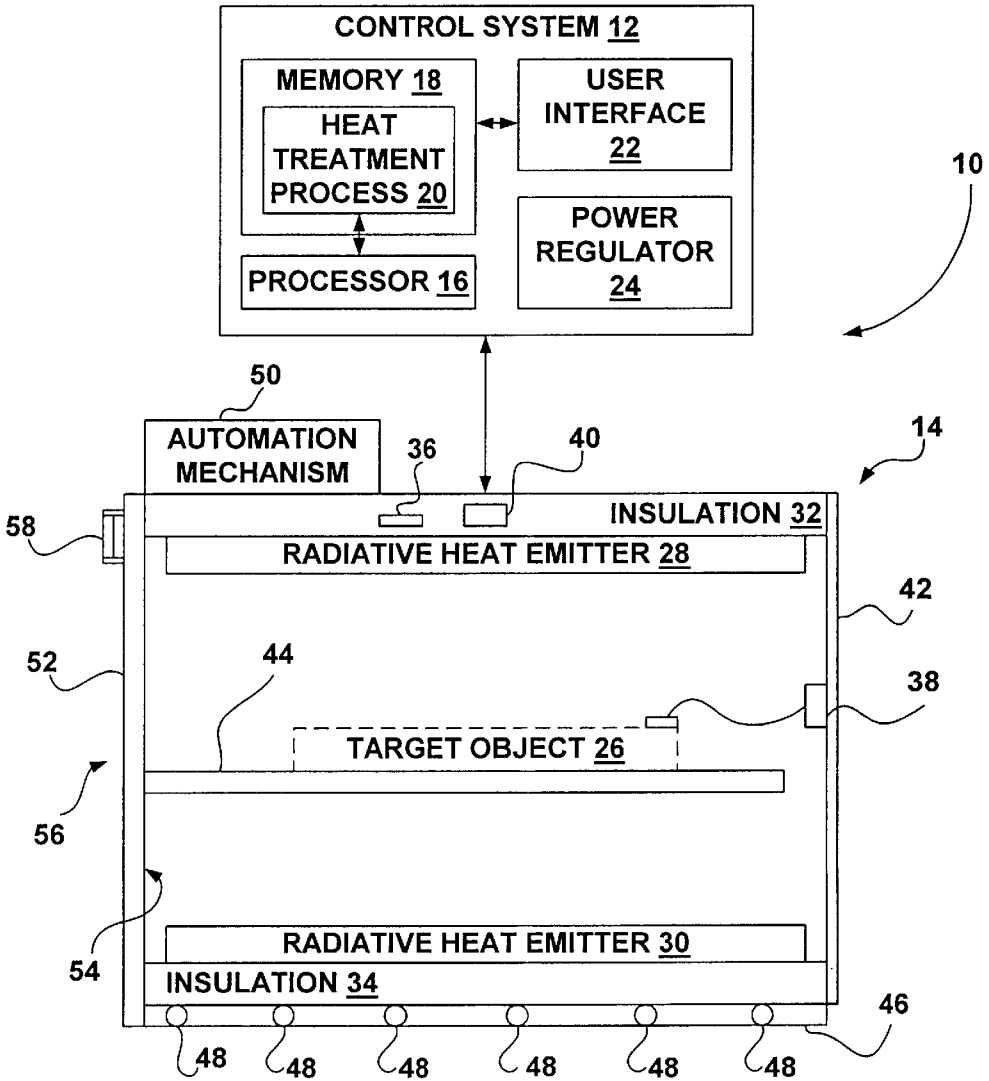
FIGS. 1 and 2 are diagrams illustrating closed and open positions of an exemplary heat treatment system of the present technique.

The present technique provides a system and method for developing a heat treatment profile for use in an industrial heat treatment system, such as a finish curing system. FIG. 1 is a diagram illustrating an exemplary model heat treatment system 10 of the present technique. As discussed in further detail below, the model heat treatment system 10 has a variety of components to simulate the operation of an industrial heat treatment system, thereby allowing a user to develop heat treatment processes for use on the industrial system. As illustrated, the model system 10 includes a control system 12 coupled to a model radiative-heating oven 14. The illustrated control system 12 may have a variety of manual and automatic control components, which facilitate an accurate and repeatable heat profile within the model radiative-heating oven 14. For example, the control system 12 may have a processor 16, a variety of memory 18, one or more heat treatment processes 20 disposed in the memory 18, a user interface 22, and a power regulator 24 to regulate the power of the model radiative-heating oven 14.

The control system 12 also may have a variety of scaling parameters, such as heat profile scaling factors, which facilitate the simulation of heating characteristics of the industrial heat treatment system in the model system 10. For example, the scaling parameters may include a variety of heating density scaling factors, such as heating output per radiative heat emitter, spacing of radiative heat emitters, power levels, and so forth. The control system 12 also may have databases of different industrial heat treatment systems, including the type and configuration of radiative heat emitters, power controllers, insulation, and so forth. Moreover, the control system 12 may allow the user to input specific parameters of the desired industrial heat treatment system. For example, each site or application may use different power levels for heat treatment processes. Accordingly, the present technique is capable of simulating the actual heating density and other characteristics within the actual industrial heat treatment system. Using this simulated or replicated heat profile, the user is able to test and develop heat treatment and curing processes on a smaller scale for subsequent use in the actual industrial heat treatment system.

In this exemplary embodiment, the model radiative-heating oven 14 also may include a variety of heating components to radiate heat onto a target object 26. As illustrated, the model radiative-heating oven 14 includes radiative heat emitters 28 and 30 disposed on opposite sides (e.g., top and bottom) of the model radiative-heating oven 14. The radiative heat emitters 28 and 30 may comprise an infrared heating lamp, a high intensity radiant emitter, or any other suitable radiant heat mechanism. It should be noted that each of the radiative heat emitters 28 and 30, and any additional heat emitters, may be controlled jointly or separately to provide the desired heating profile within the model radiative-heating oven 14. The model radiative-heating oven 14 also may have insulation panels 32 and 34 disposed adjacent the radiative heat emitters 28 and 30, respectively. For example, the insulation panels 32 and 34 may comprise a refractive material, such as an infrared refractive ceramic.

The model radiative-heating oven 14 also may include a variety of sensors or monitors, such as temperature sensors. For example, the illustrated model radiative-heating oven 14 has one or more temperature sensors 36 disposed in the insulation panels 32 and 34, respectively. The temperature sensor 36 provides temperature readings of the model radiative-heating oven 14 to the control system 12, which ensures that the temperature in the model radiative-heating oven 14 has stabilized before proceeding with one of the heat treatment processes 20. It should be noted that the present technique may have a pre-selected stabilization temperature and soak time, which ensures repeatability from one process to another within the model system 10. The model radiative-heating oven 14 also may have one or more object temperature sensors 38 and 40 for sensing the temperature of the target object 26. For example, the object temperature sensor 38 may comprise a contact temperature sensor, such as a thermocouple. The object temperature sensor 40 may comprise a non-contact temperature sensor, such as an optical temperature sensor (e.g., an infrared pyrometer). For example, the object temperature sensor 40 may. be disposed behind the radiative heat emitter 28 with an open view or receptacle to facilitate remote temperature sensing of the target object 26. In operation, the foregoing sensors 36, 38, and 40 interact with the control system 12 to ensure accurate pre-heating of the model radiative-heating oven 14, quick enclosure of the target object 26 within the model radiative-heating oven 14, subsequent heating according to a desired heat treatment process 20, and quick opening of the model radiative-heating oven 14 upon completion of the heat treatment process 20.

The actual structure of the model radiative-heating oven 14 may comprise any suitable housing 42, such as a mobile testing unit. In the illustrated embodiment, the model radiative-heating oven 14 has an object carrier 44 movably disposed within the model radiative-heating oven 14, such that the target object 26 may be moved into and out of the model radiative-heating oven 14. For example, the object carrier 44 may be operatively coupled to a linear positioning mechanism 46 having rollers 48. The object carrier 44 also may be operatively coupled to an automation mechanism 50, which may be a motorized positioning mechanism, a hydraulic mechanism, or any other suitable automated mechanism to open and close the object carrier 44 relative to the model radiative-heating oven 14. Accordingly, the automation mechanism 50 may quickly enclose the target object 26 within the model radiative-heating oven 14 after pre-heating the model radiative-heating oven 14 to provide a timely and distinct start time for the desired heat treatment process 20. After performing the desired heat treatment process 20, the automation mechanism 50 may quickly open the model radiative-heating oven 14 to provide a timely and distinct end time. For example, the foregoing quick enclosure and opening may be performed in a matter of seconds (e.g.; a minimal time for a particular application) to ensure the accuracy and repeatability of the heat treatment process 20 and to reduce undesirable heating of the target object 26.

Figure 2:
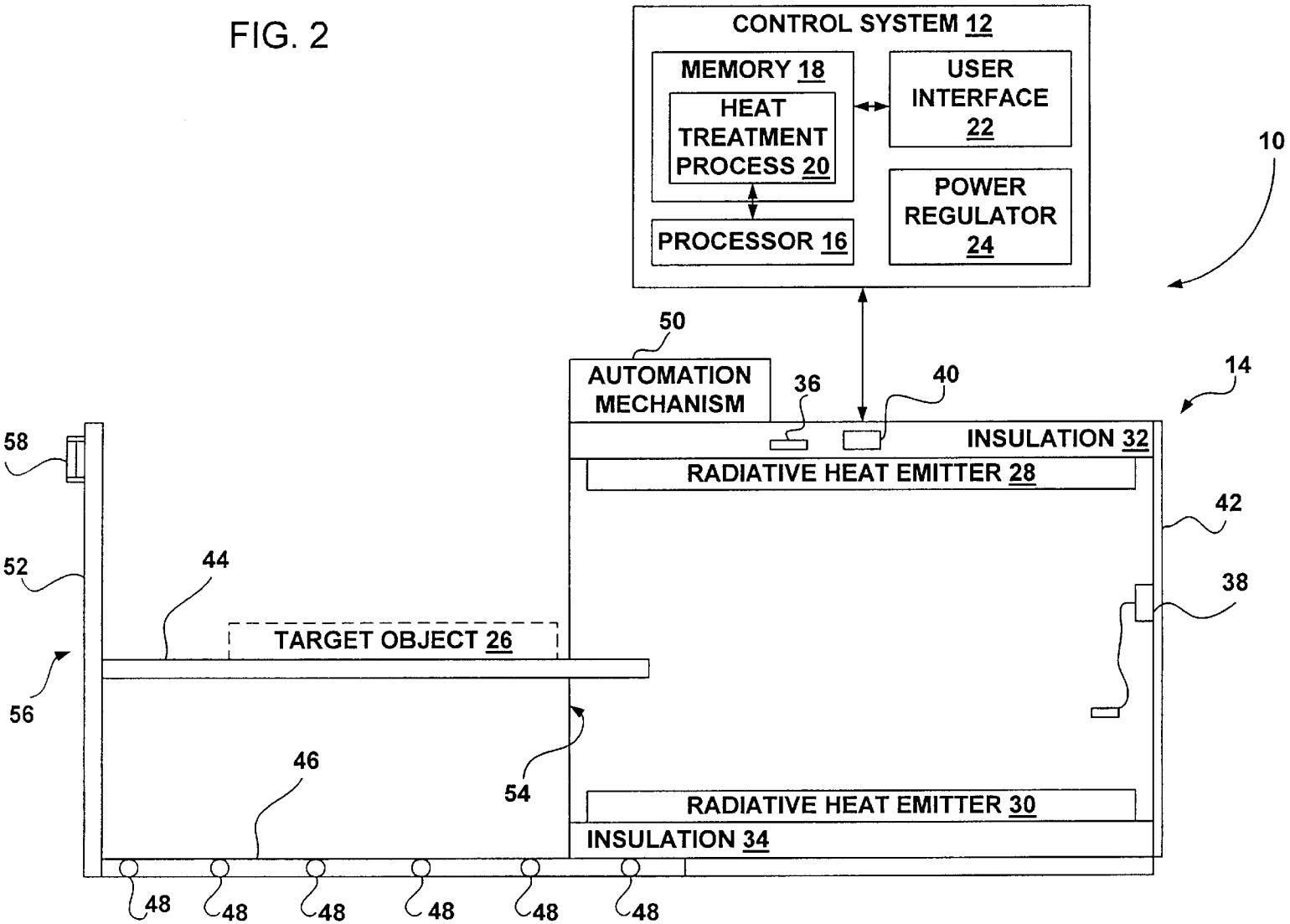

As illustrated in FIG. 2, the model radiative-heating oven 14 also may have a panel or door 52 coupled to the object carrier 44, such that the target object 26 can be moved outwardly from the model radiative-heating oven 14 through an opening 54. For example, the carrier 44 and door 52 may comprise a drawer structure 56. Alternatively, the door 52 may comprise one or more hinged panels, which are quickly openable and closable with the model radiative-heating oven 14. The drawer structure 56 also may have a handle 58, which can be used for manually opening and closing the door 52 and carrier 44. Any other suitable automatic carrier is also within the scope of the present technique.

In operation, a user interacts with the model radiative-heating oven 14 via the user interface 22 of the control system 12. For example, the user may interactively create, store, test, modify, and generally develop a heat treatment process 20. In this exemplary embodiment, the system 10 simulates the operation of an industrial heat treatment system, thereby facilitating the development of heat treatment processes for an industrial heat treatment process. In the model radiative-heating oven 14, the processor 16 utilizes the heat treatment process 20 for thermally heating the target object 26 within the model radiative-heating oven 14. For example, the user may initiate the desired heat treatment process 20 via the control system 12. The control system 12 commands the model radiative-heating oven 14 to emit a radiative heat from the radiative heat emitters 28 and 30 inwardly toward the object carrier 44 (e.g., toward the target object 26), thereby facilitating the desired heating profile within the model radiative-heating oven 14. For example, the model system 10 may radiatively heat the target object 26 to alter material properties, to cure a surface coating (e.g., a liquid or power coating), or to facilitate any other desired heating functions. The control system 12 also may use the power regulator 24 and temperature sensors 36, 38, and 40 to control the timing and power levels of the radiative heat emitters 28 and 30, such that the desired temperature profile is created within the model radiative-heating oven 14. The temperature sensors 36, 38, and 40 also may be used to monitor, analyze, and repeat the desired heating profile for subsequent use in heat treatment processes on industrial heat treatment systems.

In order to create accurate and repetitive heat profiles, the model system 10 stabilizes the heating properties within the model radiative-heating oven 14 by monitoring the temperature via the temperature sensor 36. Upon reaching the desired stable heating characteristics, the model system 10 closes the door 52 via the automation mechanism 50. The heat treatment process 20 is then executed via the control system 12. For example, the control system 12 may process and execute a variety of heat treating steps, such as a time-at-power level mode, a time-at-temperature mode, and a power level-to-temperature mode. The present technique also may use a Variety of other heat treating modes based on time duration, temperature, and power level of the radiative heat emitters 28 and 30. Upon completion of the desired heat treatment process 20, the control system 12 commands the automation mechanism 50 to open the door 52. Accordingly, the present technique provides a timely termination of heating following completion of the heat treatment process 20.

Figure 3:
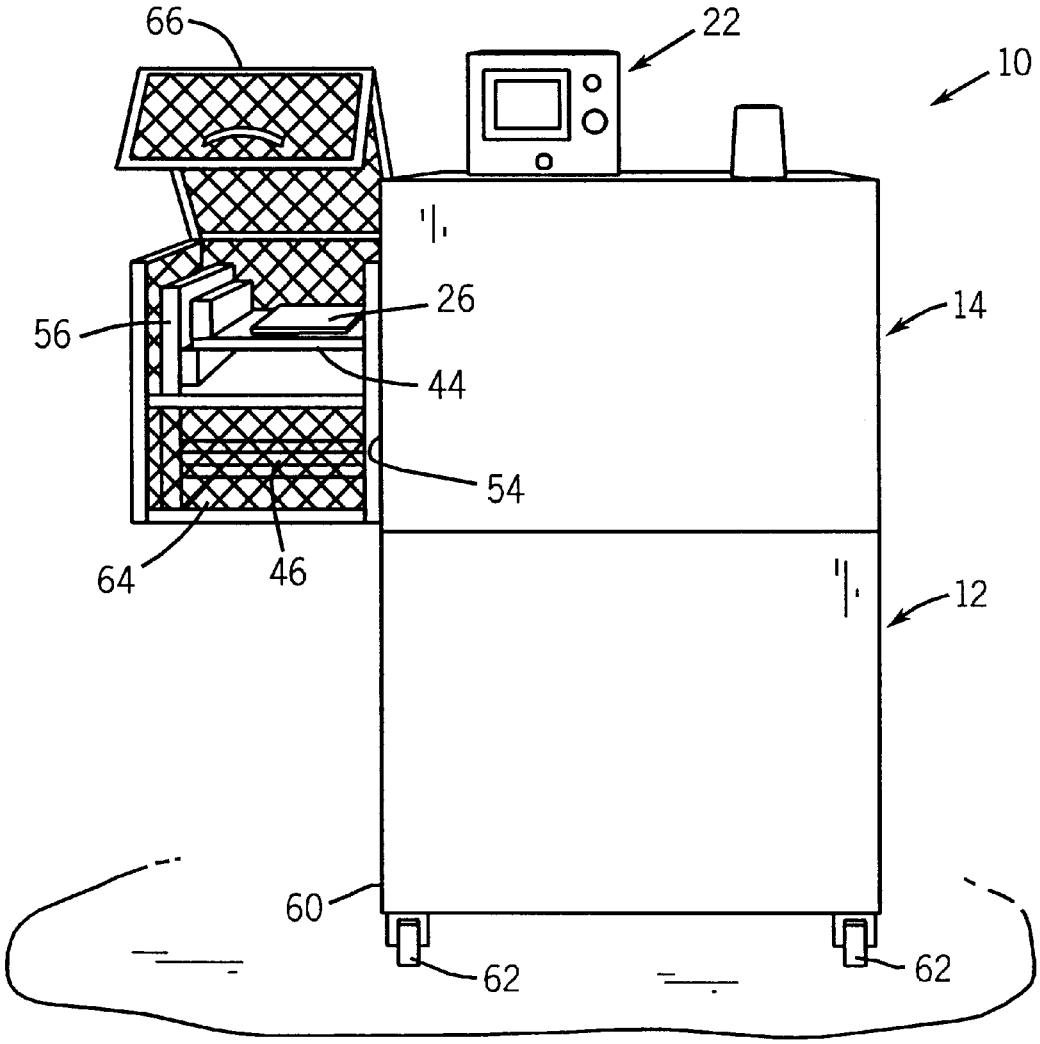
FIG. 3 is a perspective view of an embodiment of the heat treatment system illustrated in FIGS. 1 and 2.

An exemplary embodiment of the model system 10 is illustrated with reference to FIG. 3. As illustrated, the model system. 10 has the control system 12 and the model radiative-heating oven 14 disposed in a heat treatment testing housing 60, which is disposed on wheels 62. The user interface 22 is top mounted on the housing 60, while other components of the control system 12 are disposed within the housing 60. The illustrated model system 10 also has a protective enclosure or cage 64 coupled to the model radiative-heating oven 14 around the opening 54 for the drawer 56. The cage 64 ensures that the drawer 56 has sufficient space to open and close properly during testing of a heat treatment process. The illustrated cage 64 also has a hinged lid 66, which provides access to the carrier 44 and the target object 26. The position of the hinged lid 66 also may interact with the control system 12, such that testing will not commence until the hinged lid 66 is moved to a closed position. Although a particular configuration of the model system 10 is illustrated in FIG. 3, any other suitable testing equipment and configuration is within the scope of the present technique.

Figure 4:
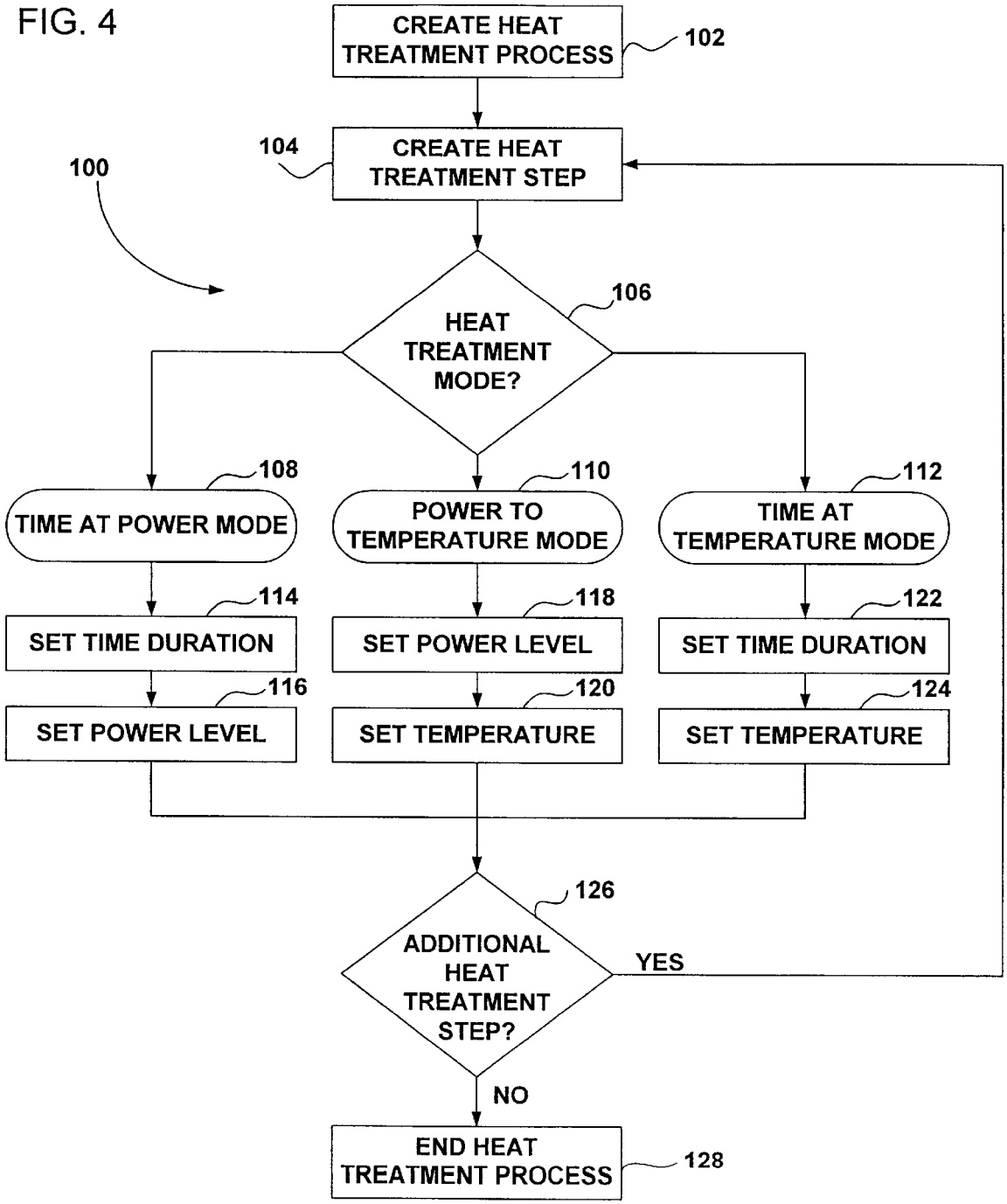
FIG. 4 is a flow chart illustrating an exemplary heat profile generation process of the present technique.

FIG. 4 is a flow chart of an exemplary heat profile generation process 100, which uses the system 10 to simulate an industrial heat treatment system for the development of a particular heat treatment process. At block 102, the process 100 begins to create a heat treatment process for radiating heat onto a target object. Accordingly, the process 100 proceeds to create a heat treatment step (block 104). At query block 106, the user selects a desired heat treatment mode for the heat treatment step. For example, the user may select a time-at-power mode 108, a power-to-temperature mode 110, or a time-at-temperature mode 112.

If the user selects the time-at-power mode 108 at query block 106, then the process 100 proceeds to set a time duration and a power level at blocks 114 and 116, respectively. For example, the user may select a time duration in seconds, minutes, or other units of time for radiative heating at a user-selected power level, such as a power level ranging between 0 and 100% of the maximum power for the particular heating device (e.g., a radiative heating emitter, such as an infrared lamp). Moreover, the user may select a different power level for each individual heating device within the model radiative-heating oven 14. The user also may create a plurality of different heating steps having a user-selected time duration and power level. For example, one step may proceed for 1 minute at 50 percent power, followed by a subsequent step for 10 minutes at 75 percent power. Each step also may provide different power levels for each of the radiative heat emitters 28 and 30. Moreover, each of the radiative heat emitters 28 and 30 may proceed at different power levels for different time durations. The present technique also may provide a number of predefined time-at-power profiles, which may be particularly well-suited for a desired application.

Alternatively, if the user selects the power-to-temperature mode 110 at query block 106, then the user proceeds to set the power level and temperature at blocks 118, and 120, respectively. For example, the user may select a power level ranging between 0 and 100% of the maximum power for the particular heating device (e.g., a radiative heating emitter, such as an infrared lamp). In operation, the model radiative-heating oven 14 heats up at the user-selected power level until the user-selected temperature is reached within the oven 14. The user also may select a different power level for each individual heating device within the model radiative-heating oven 14. If multiple steps are desired, then the user may create a plurality of different heating steps having a user-selected power level and target temperature. The present technique also may provide a number of predefined power-to-temperature profiles, which may be particularly well-suited for a desired application.

As another alternative, if the user selects the time-at-temperature mode 112 at query block 106, then the user proceeds to set the time duration and temperature at blocks 122 and 124, respectively. The user may select a time duration in seconds, minutes, or other unites of time for radiative heating at a user-selected temperature, such as a temperature ranging between 0 and the maximum possible temperature for the particular heating device (e.g., a radiative heating emitter, such as an infrared lamp). For example, one step may proceed for 1 minute at 200 degrees, followed by a subsequent step for 10 minutes at 400 degrees. Again, each of the radiative heat emitters 28 and 30 may be set to different output levels to achieve the desired temperature in the desired time. In order to maintain the desired temperature, the model system 10 may monitor the temperature via sensors 36, 38, and 40. The user also may create a plurality of different heating steps having a user-selected time duration and temperature. The present technique also may provide a number of predefined time-at-temperature profiles, which may be particularly well-suited for a desired application.

In any of the foregoing heat treatment modes, the process 100 subsequently proceeds to query the user for an additional heat treatment step at query block 126. If the user does not desire an additional heat treatment step at query block 126, then the process 100 proceeds to mark an end of the heat treatment process (block 128). Otherwise, the process 100 proceeds to formulate an additional heat treatment step at block 104. At query block 106, the user selects another one of the heat treatment modes 108, 110, and 112. The process 100 continues to add additional heat treatment steps until it creates the desired heat treatment process. Upon completion, the process 100 terminates at block 128.

Figure 5:
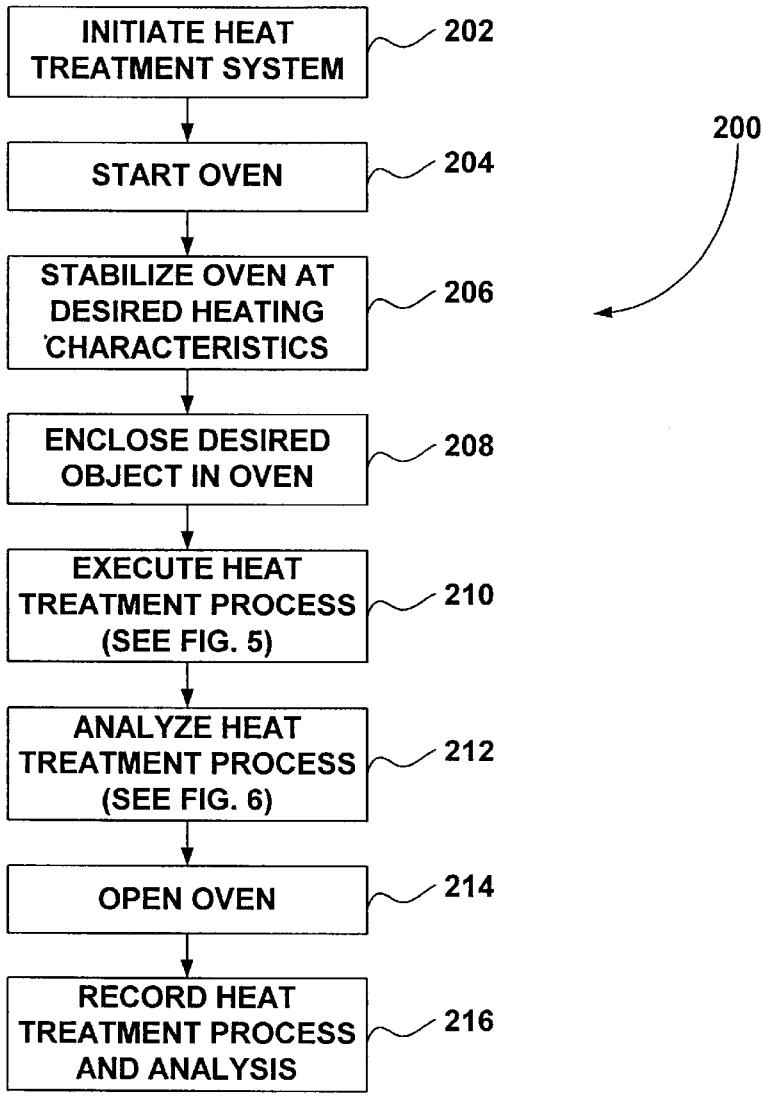
FIG. 5 is a flow chart illustrating an exemplary heat treatment testing process of the present technique.

FIG. 5 is a flow chart of an exemplary heat treatment testing process 200. At block 202, the process 200 proceeds to initiate a heat treatment system, such as model system 10. At block 204, the process 200 activates the heat treatment oven, such as model radiative-heating oven 14. The process 200 then thermally stabilizes the oven 14 at the desired heating characteristics (block 206). For example, the process 200 may radiatively heat the model radiative-heating oven 14 to a desired pre-treat temperature for a desired soak time. Accordingly, the thermal stabilization process at block 206 ensures an equivalent starting temperature for subsequent heat treatment processes executed by the model heat treatment system 10. After thermally stabilizing the oven 14 at block 206, the process 200 proceeds to enclose the desired target object 26 in the oven 14 (block 208). For example, the model radiative-heating oven 14 may automatically close the 10 door 44 to enclose the target object 26 within the housing 42 after the pre-treat temperature has been reached and maintained for a desired soak time. The process 200 then initiates the desired heat treatment process in a timely manner following the thermal stabilization and closure of the oven 14 (block 210). The process 200 also may evaluate the actual timing, oven temperatures, target object temperatures, and power levels of the oven 14 to analyze the heat treatment process (block 212). Upon completion of the heat treatment process, the process 200 may immediately open the oven at block 214. The process 200 may then record the heat treatment process and the analysis for future use and evaluation (block 216). It should be noted that the stabilization of the oven at block 206 and the opening and closing immediately before and after executing the heat treatment process at blocks 208–212 facilitates repeatability from process to process with the heat treatment system.

Figure 6:
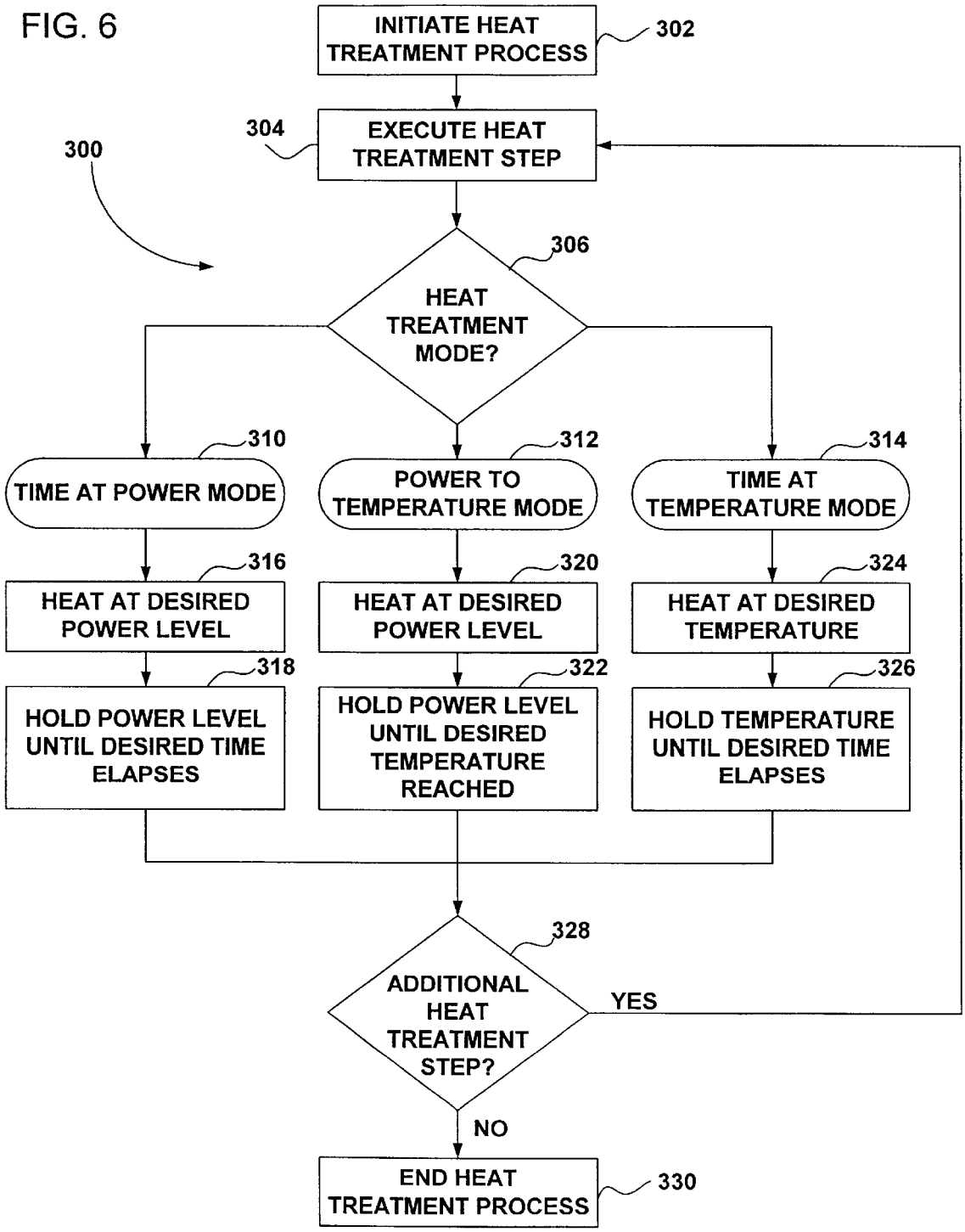
FIG. 6 is a flow chart illustrating an exemplary heat treatment process of the present technique.

FIG. 6 is a flow chart illustrating an exemplary heat treatment process 300 initiated at block 302. As discussed above, the heat treatment process may be executed on the model system 10 or on an industrial heat treatment system. At block 304, the process 300 proceeds to execute a heat treatment step, which may comprise a variety of heat treatment modes at query block 306. For example, a heat treatment mode identified a query block 306 may be a time-at-power mode 310, a power-to-temperature mode 312, or a time-at-temperature mode 314. If the heat treatment step is a time-at-power mode 310, then the process at 300 proceeds to heat the target object at the desired power level (block 216). The process 300 holds the desired power level until a desired time elapses at block 318. For example, the model radiative-heating oven 14 may emit infrared radiation from the radiative heat emitters 28 and 30 in a range of 0–100% for a desired time duration. As discussed above with reference to FIG. 3, the time-at-power mode 312 may include a variety of distinct time-at-power steps, equivalent or different heat settings for different radiative heat emitters 28 and 30, and so forth.

If the heat treatment step comprises the power-to-temperature mode 312, then the process 300 proceeds to heat the target object at the desired power level (block 320). The process 300 holds the desired power level until the desired temperature is subsequently reached. For example, the power-to-temperature heat treatment step may comprise heating the oven 14 at a power level between 0 and 100% until the target object 26 or the oven 14 reaches the desired temperature. As discussed above, the foregoing power-to-temperature mode may comprise multiple power-to-temperature steps, different settings for different radiative heat emitters 28 and 30, and so forth.

Alternatively, if the heat treatment step comprises the time-at-temperature mode 314, then the process 300 proceeds to heat the target object 26 at a desired temperature, such as a material curing temperature (block 324). The process 300 holds the desired temperature until the desired time elapses at block 326. Again, the foregoing time-at-temperature mode may include a variety of different power-to-temperature steps, different settings for different radiative heat emitters 28 and 30, and so forth.

Upon completion of a particular heat treatment step, the process 300 proceeds to identify a subsequent heat treatment step at query block 328. If the heat treatment process does not include additional heat treatment steps at query block 328, then the process 300 proceeds to end the heat treatment process at block 330. If additionally heat treatment steps are included in the heat treatment process, then the process 300 proceeds to block 304 for execution of another heat treatment step.

Figure 7:
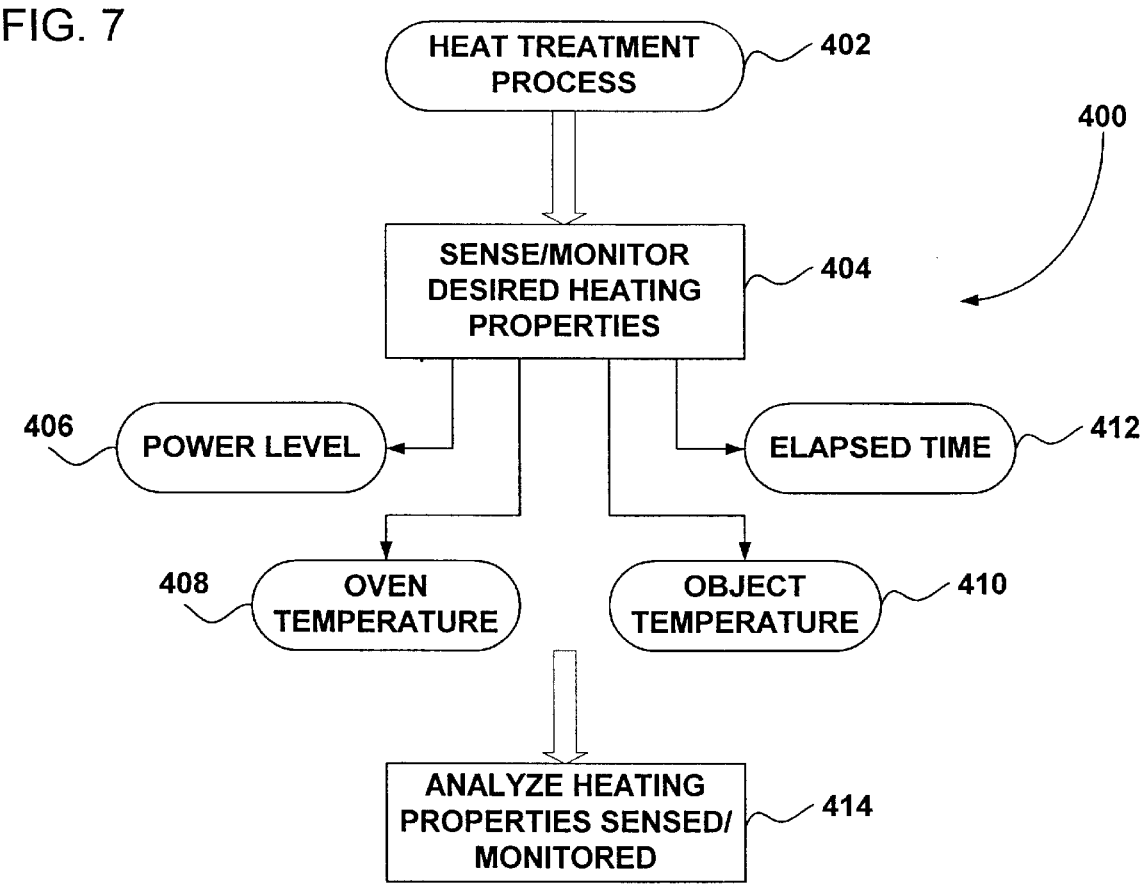
FIG. 7 is a flow chart illustrating an exemplary heat treatment analysis process of the present technique.

As discussed above, the present technique also may perform a variety of heating evaluations to develop and to ensure the accuracy and repeatability of the desired heating process. FIG. 7 is a flow chart illustrating an exemplary heat treatment analysis process 400. As illustrated, the process 400 proceeds with a heat treatment process at block 402. At block 404, the process 400 senses or monitors one or more desired heating properties or treatment characteristics, such as a power level 406, an oven temperature 408, an object temperature 410, and an elapsed time 410. The process 400 then proceeds to analyze the foregoing heating properties at block 404. For example, the process 400 may evaluate the heat profile created by each of the different heat treatment modes described with reference to FIGS. 3 and 5. Accordingly, the process 400 ensures repeatability and accuracy from one heat treatment process to another. Using one or more of the unique techniques described above with reference to FIGS. 1–7, a unique heat treatment process may be developed for a particular industrial heat treatment system and treating application, such as curing a finish coating.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An apparatus for replicating a heat profile of an industrial infrared oven, comprising:

a model infrared oven;

an infrared heat emitter disposed within the model infrared oven;

a pre-treatment temperature stabilizer coupled to the infrared heat emitter and coupled to a temperature sensor disposed within the model infrared oven; and a heat profile replicator coupled to the infrared heat emitter and having heat profile scaling parameters.

2. The apparatus of claim 1, comprising an object carrier-disposed within the model infrared oven and operatively coupled to an automatic door.

3. The apparatus of claim 2, wherein the automatic door has a quick motion mechanism providing a minimum practical open-to-close time based on a particular heat treatment application.

4. The apparatus of claim 2, wherein the automatic door comprises an automatic closure mechanism operatively coupled to the pre-treatment temperature stabilizer.

5. The apparatus of claim 1, wherein the heat profile replicator is adapted to replicate heating of the industrial infrared oven in the model infrared oven.

6. The apparatus of claim 1, wherein heat profile scaling parameters comprise scaling factors correlating heating density of the model infrared oven to the industrial infrared oven.

7. The apparatus of claim 1, wherein the model infrared oven is portable.

8. The apparatus of claim 1, comprising a power regulator coupled to the infrared heat emitter.

9. The apparatus of claim 1, wherein the pre-treatment temperature stabilizer comprises a desired soak time and temperature.

10. The apparatus of claim 1, wherein the pre-treatment temperature stabilizer is adapted to ensure repeatability by heating the model infrared oven to a desired temperature before proceeding with each heat treatment process.

11. The apparatus of claim 1, wherein the heat profile replicator comprises a time-at-power level mode operatively coupled to the infrared heat emitter.

12. The apparatus of claim 1, wherein the heat profile replicator comprises a time-at-temperature mode operatively coupled to the infrared heat emitter.

13. The apparatus of claim 1, wherein the heat profile replicator comprises a percentage power-to-temperature mode operatively coupled to the infrared heat emitter.

14. The apparatus of claim 13, wherein the heat profile generator comprises a heat treatment analyzer.

15. A system for simulating operation of an industrial radiative-heating oven, comprising:

a model radiative-heating oven, comprising:

a radiative heat emitter; and an automatic carrier; and a heat profile replicator operatively coupled to the model radiative-heating oven, comprising:

a pre-treatment thermal stabilizer;

a heat profile controller; and heat profile scaling parameters correlating heating density of the model radiative-heating oven to the industrial radiative-heating oven.

16. The system of claim 15, wherein the model radiative-heating oven is adapted to develop a heat treatment process for curing a finish coating applied to a target object.

17. The system of claim 15, wherein the heat profile replicator is adapted to provide a desired heat treatment profile repeatably and accurately from one heat treatment process to another.

18. The system of claim 15, wherein the radiative heat emitter comprises a power regulated infrared emitter.

19. The system of claim 15, wherein the radiative heat emitter comprises infrared emitters disposed on opposite interior sides of the model radiative-heating oven.

20. The system of claim 15, wherein the automatic carrier comprises an automatic closure mechanism operatively coupled to the pre-treatment thermal stabilizer.

21. The system of claim 15, wherein the automatic carrier has a quick motion mechanism adapted to minimize closing and opening times for a particular heat treatment process.

22. The system of claim 15, wherein the pre-treatment thermal stabilizer comprises a desired soak time and temperature.

23. The system of claim 15, wherein the pre-treatment thermal stabilizer is adapted to ensure repeatability by heating the enclosure to a desired temperature before proceeding with each heat treatment process.

24. The system of claim 15, wherein the heat profile controller comprises time-at-power level, time-at-temperature, and percentage power-to-temperature modes operatively coupled to the infrared heat emitter.

25. The system of claim 15, wherein the heat profile controller comprises a heat profile generator having heat treating modes based on time, temperature, and power levels.

26. A system for replicating a heat profile of an industrial radiative-heating oven, comprising:

a model radiative-heating oven;

a heat profile replicator operatively coupled to the model radiative-heating oven, comprising:

a pre-treatment oven temperature stabilizer;

a heat profile controller; and heat profile scaling parameters correlating heating density of the model radiative-heating oven to the industrial radiative-heating oven.

27. The system of claim 26, wherein the heat profile scaling parameters comprise power level parameters, heating lamp output parameters, and heating lamp spacing.

28. The system of claim 26, wherein the model radiative-heating oven comprises an infrared heat emitter.

29. The system of claim 26, wherein the model radiative-heating oven comprises an automatic object carrier that is automatically movable in and out of the model radiative-heating oven.

30. The system of claim 29, wherein the automatic object carrier has an automatic closure mechanism that is operably coupled to the pre-treatment oven temperature stabilizer.

31. The system of claim 26, wherein the model radiative-heating oven is adapted to develop a finish curing process for curing a finish coating applied to a target object.

32. The system of claim 26, wherein the heat profile controller comprises time-at-power level, time-at-temperature, and percentage power-to-temperature modes.

33. The system of claim 26, wherein the heat profile controller comprises a heat profile generator having heat treating modes based on time, temperature, and power levels.

34. A method of simulating a heat profile of an industrial infrared oven, comprising the acts of:

pre-heating a model infrared oven to a desired temperature;

enclosing an object carrier within the model infrared oven;

radiatively heating the model infrared oven using a heat treatment profile and scaling parameters; and opening the model infrared oven.

35. The method of claim 34, wherein the act of pre-heating comprises the act of thermally stabilizing the model infrared oven at the desired temperature.

36. The method of claim 34, wherein the act of enclosing the object carrier comprises the act of automatically closing the model infrared oven after the act of pre-heating.

37. The method of claim 36, wherein the act of radiatively heating the model infrared oven proceeds after the act of enclosing the object carrier.

38. The method of claim 34, wherein the act of radiatively heating the model infrared oven comprises the act of radiating infrared heat for a desired time at a desired power level.

39. The method of claim 34, wherein the act of radiatively heating the model infrared oven comprises the act of radiating infrared heat for a desired time at a desired temperature.

40. The method of claim 34, wherein the act of radiatively heating the model infrared oven comprises the act of radiating infrared heat at a desired power level until a desired temperature is reached.

41. The method of claim 34, wherein the act of radiatively heating comprises the act of developing a finish curing process for curing a finish coating applied to a target object.

42. The method of claim 34, wherein the act of radiatively heating comprises the act of developing a heat treatment process for altering material properties of a target object.

43. The method of claim 34, wherein the act of opening the model infrared oven comprises the act of automatically opening the model infrared oven after the act of radiatively heating.

44. The method of claim 34, wherein the acts of pre-heating, enclosing, radiatively heating, and opening comprise the act of simulating the industrial infrared oven to develop a heat treatment profile for use in the industrial infrared oven.

45. A method of modeling an industrial infrared oven to develop a heat treatment profile for use in the industrial infrared oven, comprising the acts of:

heating a model infrared oven to a pre-treat temperature;

enclosing the object carrier within the model infrared oven;

radiating infrared heat from high intensity radiative emitters toward the object carrier using desired time, temperature, and power settings based on scaling factors between the industrial infrared oven and the model infrared oven; and generating the heat treatment profile for use in the industrial infrared oven.

46. The method of claim 45, comprising the act of scaling heating characteristics of the model infrared oven to those of the industrial infrared oven.

47. The method of claim 46, wherein the act of scaling heating characteristics comprises the act of matching the heating density of the model infrared oven to that of the industrial infrared oven.

48. The method of claim 45, wherein the act of heating comprises the act of thermally stabilizing the model infrared oven at the pre-treat temperature for a desired soak time.

49. The method of claim 45, wherein the act of enclosing the object carrier comprises the act of automatically closing the model infrared oven after the act of heating and before the act of radiating infrared heat.

50. The method of claim 45, wherein the act of generating the heat treatment profile comprises the act of formulating a curing process for a finish coating.

51. The method of claim 45, wherein the act of generating the heat treatment profile comprises the act of formulating a heat treatment process for altering material properties of a desired object.

52. The method of claim 45, comprising the act of automatically opening the model infrared heat.

* * * * *